US009506327B2

(12) United States Patent
Vu et al.

(10) Patent No.: US 9,506,327 B2
(45) Date of Patent: Nov. 29, 2016

(54) CONTAINMENT SYSTEM AND A METHOD FOR USING SUCH CONTAINMENT SYSTEM

(71) Applicant: TOTAL SA, Courbevoie (FR)

(72) Inventors: Van-Khoi Vu, Paris (FR); Jean-Claude Bourguignon, Pau (FR); Guillaume Vaillant, Pau (FR)

(73) Assignee: TOTAL SA, Courbevoie (FR)

( * ) Notice: Subject to any disclaimer, the term of this patent is extended or adjusted under 35 U.S.C. 154(b) by 0 days.

(21) Appl. No.: 14/426,244

(22) PCT Filed: Sep. 9, 2013

(86) PCT No.: PCT/EP2013/068644

§ 371 (c)(1),
(2) Date: Mar. 5, 2015

(87) PCT Pub. No.: WO2014/037569

PCT Pub. Date: Mar. 13, 2014

(65) Prior Publication Data

US 2015/0211340 A1 Jul. 30, 2015

Related U.S. Application Data

(60) Provisional application No. 61/698,258, filed on Sep. 7, 2012.

(51) Int. Cl.

| | |
|---|---|
| ***E02B 15/04*** | (2006.01) |
| ***E21B 43/01*** | (2006.01) |
| *E02B 15/00* | (2006.01) |

(52) U.S. Cl.

CPC ..... *E21B 43/0122* (2013.01); *E02B 15/04* (2013.01); *E02B 15/046* (2013.01); *E02B 2015/005* (2013.01)

(58) Field of Classification Search

CPC ..... E02B 15/00; E02B 15/04; E02B 15/045; E02B 15/046; E02B 2015/005; E21B 43/0122

See application file for complete search history.

(56) References Cited

U.S. PATENT DOCUMENTS

| | | | |
|---|---|---|---|
| 3,643,741 A | 2/1972 | Miranda | |
| 3,667,605 A | 6/1972 | Zielinski | |

(Continued)

FOREIGN PATENT DOCUMENTS

| | | | |
|---|---|---|---|
| FR | 2804935 | 8/2001 | |
| FR | 2961843 A1 * | 12/2011 | ..... E21B 43/0122 |

(Continued)

OTHER PUBLICATIONS

Notification of Transmittal, International Search Report and the Written Opinion of the International Searching Authority for PCT/EP2013/068644, mailed May 9, 2014, 10 pgs.

(Continued)

*Primary Examiner* — Frederick L Lagman
(74) *Attorney, Agent, or Firm* — Patterson Thuente Pederson, P.A.

(57) ABSTRACT

A containment system for recovering hydrocarbon fluid from a leaking device comprising a dome sealed to the seafloor around the leaking device and forming a cavity for accumulating hydrocarbon fluid. The dome comprises an upper output opening for extracting the hydrocarbon fluid. The containment system comprises a sensor for measuring an interface level of a fluid interface between hydrocarbon fluid and any other fluid inside the dome, and an output valve connected to the upper output opening for outputting hydrocarbon fluid, and controlled on the basis of the interface level measured by the sensor.

11 Claims, 3 Drawing Sheets

(56) References Cited

U.S. PATENT DOCUMENTS

| | | | | |
|---|---|---|---|---|
| 3,762,548 | A | 10/1973 | McCabe | |
| 4,395,157 | A * | 7/1983 | Cunningham | E21B 43/0122 405/195.1 |
| 4,531,860 | A * | 7/1985 | Barnett | E21B 43/0122 210/923 |
| 5,213,444 | A * | 5/1993 | Henning | B01D 17/00 405/60 |
| 8,025,103 | B1 | 9/2011 | Wolinsky | |
| 2006/0283590 | A1 | 12/2006 | Poldervaart | |
| 2011/0274493 | A1 | 11/2011 | Cutts | |
| 2011/0293372 | A1 | 12/2011 | Later | |
| 2011/0299929 | A1* | 12/2011 | Sabourin | E21B 43/0122 405/60 |
| 2011/0315233 | A1 | 12/2011 | Carter | |
| 2011/0315393 | A1 | 12/2011 | Wolinsky | |
| 2011/0315396 | A1 | 12/2011 | Wolinsky | |
| 2012/0024533 | A1 | 2/2012 | Ivic | |
| 2012/0051840 | A1* | 3/2012 | Hatton | E21B 43/0122 405/60 |
| 2012/0073823 | A1 | 3/2012 | McClanahan et al. | |
| 2012/0087729 | A1 | 4/2012 | Oesterberg et al. | |
| 2012/0118580 | A1 | 5/2012 | Swanson | |
| 2012/0125623 | A1 | 5/2012 | Cargol, Jr. et al. | |
| 2012/0155964 | A1* | 6/2012 | Carter | E21B 43/0122 405/60 |
| 2012/0181041 | A1 | 7/2012 | Willman | |
| 2012/0186822 | A1 | 7/2012 | Mahajan | |
| 2012/0213588 | A1* | 8/2012 | Shifferaw | B63B 35/32 405/60 |
| 2012/0247781 | A1 | 10/2012 | Noble et al. | |
| 2012/0251244 | A1* | 10/2012 | Toedtman | C02F 1/40 405/60 |
| 2013/0046126 | A1* | 2/2013 | Varney | B63B 35/32 588/260 |
| 2013/0074757 | A1* | 3/2013 | McAlister | B01J 7/00 114/264 |
| 2013/0118754 | A1* | 5/2013 | Worrall | E21B 37/06 166/344 |
| 2013/0177356 | A1 | 7/2013 | Edmondson | |
| 2013/0183098 | A1* | 7/2013 | Halal | E02B 15/045 405/60 |
| 2013/0270194 | A1* | 10/2013 | Allen | B67D 99/00 210/747.4 |
| 2014/0356068 | A1* | 12/2014 | Andritsos | B63C 7/006 405/60 |

FOREIGN PATENT DOCUMENTS

| | | | | |
|---|---|---|---|---|
| FR | 2972216 | A1 * | 9/2012 | E21B 43/0122 |
| GB | 2480112 | A | 11/2011 | |
| WO | WO 2011/154733 | A1 | 12/2011 | |
| WO | WO 2011/163239 | A1 | 12/2011 | |
| WO | WO 2011/163573 | A2 | 12/2011 | |
| WO | WO 2012/050823 | A2 | 4/2012 | |

OTHER PUBLICATIONS

International Application No. PCT/EP2013/065359, filed Jul. 19, 2013, International Search report, mailed May 14, 2014, 3 pages.

International Application No. PCT/EP2013/068640, filed Sep. 9, 2013, International Search report mailed May 22, 2014, 4 pages.

Application and File History for U.S. Appl. No. 14/425,622, filed Mar. 3, 2015, Inventors: Vu et al.

Application and File History for U.S. Appl. No. 14/426,287, filed Mar. 5, 2015, Inventors: Vu et al.

* cited by examiner

CONTAINMENT SYSTEM AND A METHOD FOR USING SUCH CONTAINMENT SYSTEM

RELATED APPLICATIONS

The present application is a National Phase entry of PCT Application No. PCT/EP2013/068644, filed Sep. 9, 2013, which claims priority from U.S. Patent Application No. 61/698,258 filed Sep. 7, 2012, said applications being hereby incorporated by reference herein in their entirety.

FIELD OF THE INVENTION

The present invention concerns a containment system for recovering spilled oil that is leaking under water.

BACKGROUND OF THE INVENTION

The present invention concerns more precisely a containment system for recovering a hydrocarbon fluid from a leaking device that is situated at the seafloor and that is leaking the hydrocarbon fluid from a well.

Recovering oil that is leaking from an under water oil device is a great problem, especially for oil device that are installed at deep sea floor.

The explosion on the "Deepwater Horizon" platform in the Gulf of Mexico demonstrated how much such a containment system is difficult to control.

One of the main problems was the formation of hydrates that clogged the used containment system.

For example, at a depth of around 1500 meters, the sea water is cold (for example around only 5° C.) and at a high pressure. These environmental conditions may transform the sea water and hydrocarbon fluid into hydrates having a quasi-solid phase and which can fill and clog any cavity.

Hydrate inhibitors like methanol could be injected to avoid hydrate formation. But, the needed quantity of such chemical is huge and inhibitors are also pollution for the environment.

SUMMARY OF THE INVENTION

One object of the present invention is to provide a containment system that avoids the formation of hydrates inside the dome.

To this effect, the containment system of the present invention is adapted to be landed at the seafloor corresponding to a base level of the containment system. It comprises a dome forming a cavity under said dome, said cavity being adapted to completely surround and include the leaking device, and to accumulate hydrocarbon fluid coming upwardly from the leaking device, said dome comprising at least one upper output opening adapted to extract the hydrocarbon fluid for recovery.

The dome further comprises:

- a sensor for measuring an interface level of a fluid interface between hydrocarbon fluid and any other fluid inside the dome,
- an output valve connected to the upper output opening for outputting hydrocarbon fluid from the cavity, said output valve being controlled on the basis of the interface level measured by the sensor.

Thanks to these features, the level of hydrocarbon fluid contained inside the dome volume around the leaking device can be maintained at a predetermined level.

The hydrocarbon fluid outputting from the leaking device is usually hot compared to the cold sea water.

A large portion of hydrocarbon fluid can be maintained to keep the dome volume at a high temperature, heated by the hydrocarbon fluid itself.

Therefore, hydrate formation is prevented inside the cavity of the containment system of the present invention.

Hydrate inhibitors that are usually used can be cancelled or their used quantity can be largely reduced.

In various embodiments of the containment system, one and/or other of the following features may optionally be incorporated.

According to an aspect of the containment system, the output valve is controlled so as to keep the interface level lower or equal to a level of output of the hydrocarbon fluid from the leaking device.

The jet of hydrocarbon fluid at the output of the leaking device is above the interface level, i.e. inside the hydrocarbon fluid accumulated bellow the dome. Said jet is not cooled by the sea water. The cold sea water is not sucked by the jet inside the hydrocarbon fluid accumulated bellow the dome. Hydrate formation is prevented.

According to an aspect of the containment system, it further comprises a control unit that implements a level control law so as to keep the interface level lower or equal to a level of output of the hydrocarbon fluid from the leaking device.

According to an aspect of the containment system, the dome comprises:

- a first valve for extracting a gas component from the cavity, said first valve being positioned on the dome at a level proximal to a highest level of the dome, and
- a second valve for extracting a liquid component from the cavity, said second valve being positioned on the dome at an intermediate level intermediate between the base level and the highest level of the dome.

According to an aspect of the containment system, it further comprises a control unit that implements a separation control law that controls the first valve so as a gas interface level is lower than the highest level of the dome, and so as a liquid interface level is lower than the intermediate level.

Eventually, there is only one first valve for extracting the gas component and the liquid component of the hydrocarbon fluid.

According to an aspect of the containment system, the dome comprises an over pressure valve that extracts fluid out from the cavity to the environment if a pressure difference between the cavity and the environment exceeds a predetermined pressure limit.

According to an aspect of the containment system, the dome comprises an injection device that inputs an injection fluid into the cavity.

According to an aspect of the containment system, the injection device comprises a plurality of output ports inside the cavity, said output ports being fed with the injection fluid.

According to an aspect of the containment system, the injection fluid comprises one or a combination of the fluid components chosen in the list of an alcohol, an ethanol, a methanol, a glycol, an ethylene glycol, a diethylene glycol, and a low-dosage hydrate inhibitor (LDHI).

Another object of the invention is to provide a method for using a containment system for recovering hydrocarbon fluid from a leaking device that is situated at the seafloor and that is leaking hydrocarbon fluid from a well. The containment system comprises:

- a dome forming a cavity, said cavity being adapted to completely surround and include the leaking device, and to accumulate hydrocarbon fluid coming upwardly from the leaking device, said dome comprising at least one upper output opening, a sensor, and an output valve connected to the upper output opening.

The method comprises the following successive steps:

a1) measuring by the sensor an interface level of a fluid interface between hydrocarbon fluid and any other fluid inside the dome, b1) controlling the output valve on the basis of the interface level measured by the sensor for outputting hydrocarbon fluid from the cavity.

In various embodiments of the method, one and/or other of the following features may optionally be incorporated.

According to an aspect of the method, at step b, the output valve is controlled so as to keep the interface level lower or equal to a level of output of the hydrocarbon fluid from the leaking device.

According to an aspect of the method, the dome further comprises an injection device that is able to input an injection fluid into the cavity, and before landing the containment system at the seafloor and surrounding the leaking device, the method comprises the following steps:

a2) measuring by the sensor a first interface level (IL1) of a fluid interface between hydrocarbon fluid and injection fluid inside the dome, b2) controlling the output valve on the basis of the first interface level measured by the sensor for outputting hydrocarbon fluid from the cavity, c2) measuring by the sensor a second interface level of a fluid interface between injection fluid and water inside the dome, and d2) controlling the injection device on the basis of the second interface level measured by the sensor for adding injection fluid inside the cavity.

According to an aspect of the method, at step b2) the upper output opening is controlled so as to keep the first interface level at a level higher than a first predetermined level, said first predetermined level being preferably proximal to the upper output opening.

According to an aspect of the method, at step d2) the injection device is controlled so as to keep the second interface level at a level lower than a second predetermined level, said second predetermined level being preferably proximal to the base level.

BRIEF DESCRIPTION OF THE DRAWINGS

Other features and advantages of the invention will be apparent from the following detailed description of at least one of its embodiments given by way of non-limiting example, with reference to the accompanying drawings. In the drawings.

DETAILED DESCRIPTION OF THE DRAWINGS

In the various figures, the same reference numbers indicate identical or similar elements. The direction Z is a vertical direction. A direction X or Y is a horizontal or lateral direction. These are indications for the understanding of the invention.

Figure 1:
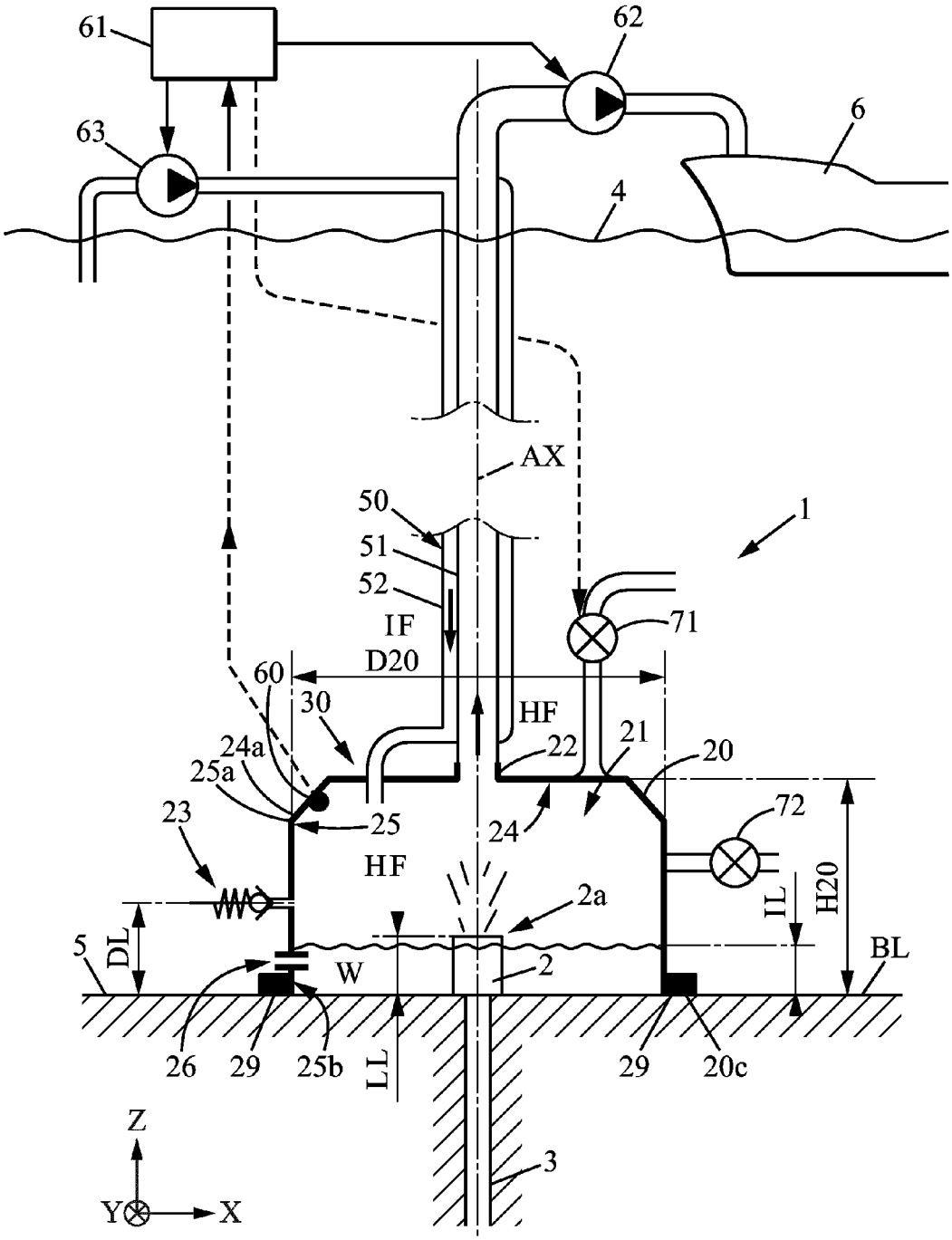
FIG. 1 is a schematic view of a vertical cut of a containment system according to the invention.

As shown on FIG. 1, the containment system 1 of the present invention is adapted for recovering hydrocarbon fluid from a leaking device 2 that is situated at a seafloor 5 of a deep offshore installation. The leaking device 2 is for example the well itself, a pipeline, a blow out preventer device, a wellhead or any device connected to the wellhead. The seafloor 5 is for example at more than 1500 meters deep below the sea surface 4. At this depth, the sea water is cold, for example around only 5° C. and at high pressure.

The hydrocarbon fluid may be liquid oil, natural gas, or a mix of them.

The leaking device 2 is leaking a hydrocarbon fluid from a subsea well 3. The hydrocarbon fluid exiting from the subsea may be rather hot, for example above 50° C. However, the environment cold temperature and high pressure may transform the sea water and hydrocarbon fluid into hydrates having a quasi-solid or solid phase. These hydrates can fill and clog any cavity.

The containment system 1 of the present invention is landed and fixed to the seafloor by any means, such as anchoring or heavy weights 29 for compensating the upward Archimedes force applied on the containment system 1 by the hydrocarbon fluid that is lighter than the sea water (lower mass density). The seafloor corresponds in the present description to a base level of the containment system 1. The other levels are defined going upwards, in the vertical direction Z towards the sea surface 4.

The containment system 1 of present invention comprises at least:

a dome 20 forming a cavity 21 under said dome 20, said cavity accumulating the hydrocarbon fluid, and an upper output opening 22 to extract the hydrocarbon fluid for recovering.

The dome 20 can be sealed on the seafloor.

The containment system 1 may additionally comprise an over pressure valve 23 to extract fluid from the cavity to the environment if a pressure difference between the cavity and the environment exceeds a pressure limit.

The dome 20 is preferably fixed to the seafloor.

For example, the dome 20 comprises foot 20*c* having heavy weights for maintaining and securing the dome 20 to the seafloor.

The dome 20 completely surrounds the leaking device 2. In a horizontal plane (XY), the dome 20 has a closed loop shape encompassing the leaking device 2. Said shape may be for example a circle shape, a square shape or any polygonal shape.

The dome 20 has a diameter D20. This outer diameter corresponds to a maximum distance between two internal points of the dome, taken in a horizontal plane at a level near the base level BL. The diameter D20 is for example of 6 meters or more.

The dome 20 is higher than a total height of the leaking device 2. It has a height H20 of approximately 3 meters or more. It completely includes the leaking device 2 (i.e. the part above the base level. All that is under the seafloor is not taken into account as the dome is sealed to the seafloor).

The dome 20 defines an inner dome volume, called the cavity 21. This cavity volume communicates with the environment sea water via lower opening 26 near the seafloor 5. Pressure between inside and outside of the cavity 21 is then balanced (equalized).

The dome 20 is a hollow structure having:

an upper portion 24 extending in a radial direction to an outer peripheral end 24*a*, said radial direction being perpendicular to the vertical direction AX (equal to direction Z on the figure), and a lateral portion 25 extending from the upper portion 24 downwardly between an upper end 25*a* and a lower end 25*b*, said lower end 25*b* comprising for example the foot 20*c*.

The lateral portion 25 has said diameter D20.

The lateral portion 25 of the dome is downwardly opened so as to surround the leaking device 2.

The dome 20 comprises an upper output opening 22 having of small diameter compared to the dome diameter. Said upper output opening is adapted to be connected to a pipe 50 for extracting the hydrocarbon fluid from the containment system 1 to a recovery boat 6 at the sea surface 4, so as the hydrocarbon fluid is recovered.

In a vertical plane (XZ), the upper portion 24 of the dome 20 may have a convergent shape from the lateral portion 25 up to the upper output opening 22. The dome 20 is a cover that can have advantageously an inverted funnel shape.

The hollow structure of the dome 20 forms a largely opened cavity 21 in the direction to the seafloor. It is positioned above and around the leaking device 2 so as to accumulate the light hydrocarbon fluid.

The cavity 21 accumulates hydrocarbon fluid coming upwardly from the leaking device 2, i.e. oil and/or natural gas. The hydrocarbon fluid fills the upper volume of the cavity, down to an interface level IL.

Moreover, the dome 20 may comprise upper and lateral portions 24, 25 that comprise thermal insulating material, so as to thermally insulate the cavity 21 from the cold environment of sea water. Ideally, the dome 20 may be manufactured with at least a thermally insulating material, said thermally insulating material preferably having a thermal conductivity lower than 0.1 $W \cdot m^{-1} \cdot K^{-1}$.

The following thermal insulation materials may be used: synthetic material such as Polyurethane (PU) or polystyrene material, or a fibre textile with Polyvinyl chloride (PVC) coating or PU coating, or Alcryn®. The thermal insulation material may be foam, or a gel contained inside a double wall structure.

The dome 20 may comprise a plurality of walls, layers or envelopes for improving the thermal insulation. Between the layers, insulation materials may be included, or heating devices (electric, hydraulic or of any kind) to improve again the thermal insulation of the dome.

The thermal insulation of the dome 20 passively insulates the cavity 21, while the first injection device 30 actively insulates the cavity 21. Both effects prevent the formation of hydrates inside the cavity 21.

The cavity 21 is a volume storing a quantity of hydrocarbon fluid and absorbing the fluctuations of hydrocarbon fluid flows.

The containment system 1 of the present invention comprises:

a sensor 60 for measuring the interface level IL of the fluid interface between the hydrocarbon fluid and any other fluid (e.g. sea water) inside the dome 20, an output valve 62 connected to the upper output opening 22 for extracting the hydrocarbon fluid from the cavity 21.

The output valve 62 is operated or controlled on the basis of the interface level IL measured by the sensor 60.

The control of the output valve may be manual or automatic.

In a manual control, a user reads the value of the interface level and determines to open or close the output valve 62.

In an automatic control, the containment system further comprises a control unit 61 that implements a level control law that calculates a control value on the basis of a measured value of the interface level IL, and that operates the output valve 62 on the basis of the control value. The control unit 61 closes or opens the output valve 62 for outputting hydrocarbon fluid from the cavity.

Additionally, the output valve 62 may be controlled so as to keep the interface level IL at a level inside the cavity 21, said level being constant.

Advantageously, the level is lower or equal to a leaking level LL, said leaking level being a level of output of hydrocarbon fluid from the leaking device (see FIG. 1).

The jet of hydrocarbon fluid outputting from the leaking device 2 is therefore going directly inside the hydrocarbon fluid accumulated inside the cavity 21. The jet is not in contact with sea water at its output from the leaking device. The cold sea water is not sucked by the jet. Hydrate formation is then prevented.

Advantageously, the level is higher than the leaking level LL, but at a predetermined small distance, said distance being lower than 50 cm, or preferably lower than 1 m. The jet of hydrocarbon fluid does not suck the sea water, and the sucked sea water is going back downwardly inside the dome by the effect of gravity.

This case may happen when the jet of hydrocarbon fluid is at a leaking level LL lower than the level of the lower opening 26, and particularly when the jet is directed in a horizontal direction.

Advantageously, the level is higher or equal to the level of the lower opening 26 so no hydrocarbon fluid is leaking from the cavity to the environment into the sea water.

The containment system 1 may also comprise an injection device 30 that injects an injection fluid IF into the cavity 21.

The injection device 30 may comprise a plurality of output ports spread inside the volume of the cavity, so as to ensure a uniform mixing of the injection fluid into the hydrocarbon fluid inside the cavity 21.

The injection device 30 may inject injection fluid IF from the upper portion 24, the lateral portion 25 or from both portions 24, 25 of the dome 20.

Thank to the control of the fluid interface level IL inside the dome, the various flow of injection fluid to each portion of the dome can be determined, and the injection system 30 is itself more efficient to prevent hydrate formation.

The injection fluid IF may be sea water pumped near the sea surface 4 via a pump 63. The pumped sea water may be used as it, i.e. at the temperature of sea water at the sea surface 4, or heated by additional means. Its temperature is therefore much higher than the temperature of sea water at the seafloor depth.

The injection fluid may be an alcohol, an ethanol, a methanol, a glycol, an ethylene glycol, a diethylene glycol, and a low-dosage hydrate inhibitor (LDHI). The LDHI are fluids that include a mix of at a kinetic inhibitor fluid and an anti-agglomerant fluid. A kinetics inhibitor fluid is a fluid that delays the formation of hydrates. An anti-agglomerant fluid is a fluid that prevents to agglomeration of the hydrates into large solids; only small hydrates are formed.

The injection fluid may additionally heated or not.

The pipe 50 is advantageously a two concentric tube pipe, having an inner pipe 51 forming an inner channel, and an outer tube 52 surrounding said inner pipe 51 and forming an annular channel between the inner tube and the outer tube. The inner channel may be connected to the upper output opening 22 and used to extract the hydrocarbon fluid from the cavity 21. The annular channel may be therefore connected to the injection system 30, and used to feed it with the warm fluid from the surface. However, it is apparent that the two channels of such pipe can be connected to the dome according to the other inverse possibility without any change.

The sensor 60 may provide the interface level via a direct or indirect measurement. For example, the sensor 60 may be composed of a plurality of temperature or pressure sensors positioned along a vertical direction Z inside the cavity 21. The evolution of the measured temperature or pressure indicates the position of the interface level IL. The sea water is cold and the hydrocarbon fluid is hot or warm. The discontinuity in the measured temperature or pressure indicates the position of the interface level IL inside the cavity 21.

The sensor 60 may also provide measurements concerning other interface levels.

For example, the sensor 60 may provide a gas interface level corresponding to a level of an interface between a gas component and a liquid component of the hydrocarbon fluid contained inside the cavity 21.

Additionally, the dome 20 may comprise a first output valve 71 for extracting the gas component from the cavity. The first output valve is positioned at a highest level of the dome, i.e. on the upper portion 24 of the dome (the cover).

The first output valve 71 is then controlled on the basis of the gas interface level measurement provided by the sensor 60.

The gas component of the hydrocarbon fluid extracted from the first output valve 71 may be recovered by a pipe to the recovery boat 6.

Moreover, the dome 20 may comprise a second output valve 72 for extracting the liquid component from the hydrocarbon fluid inside the cavity 21. The second output valve 72 is positioned at an intermediate level between the base level and the highest level of the dome. The second output valve 72 is then controlled on the basis of the interface level IL, the interface level being the level of a fluid interface between hydrocarbon fluid (liquid component) and any other fluid.

Advantageously, the second output valve 72 is controlled so as to keep the interface level IL lower or equal to the intermediate level of said second output valve 72.

The liquid component of the hydrocarbon fluid extracted from the second output valve 72 may be recovered by a pipe to the recovery boat 6.

Thanks to the above first and second output valves 71, 72, gas component and liquid component of the hydrocarbon fluid can be directly extracted from the cavity 21. The dome 20 is used as a phase or components separator.

Thanks to the above first and second output valves 71, 72 and their control, the quantity of light fluid inside the dome 20 has a determined and measured value. Knowing the nature of fluid components and their quantity inside the dome, the buoyancy of the dome can be determined. Additionally, these valves can be controlled so that the buoyancy is lower or equal to a predetermined buoyancy limit. Taking into account the weights of containment system components, the containment system buoyancy can be determined, and the containment system 1 can be kept stable at the seafloor 5.

The control of the first and second output valves 71, 72 can be manual (e.g. operated by a remotely operated vehicle) or automatic by implementing a control law according the above rules inside the control unit 61.

The control unit 61 may be a single control unit that controls all the valves, or may be composed of a plurality of units that are either interconnected or independent to each other one of said plurality.

The output valve 62 or the first output valve 71 may be used as a vent valve, for evacuating large quantities of hydrocarbon fluid inside the cavity 21 during the installation of the containment system 1 above the leaking device 2. The vent valve can be opened or controlled during the first steps of installation before landing at seafloor. During these steps most of the hydrocarbon fluid may be evacuated to reduce or cancel its buoyancy Archimedes force and to prevent hydrates formation.

The dome 20 may also comprises an over pressure valve 23 that extract fluid out of the cavity 21 to the environment if a pressure difference between the cavity 21 and the environment exceeds a predetermined pressure limit.

The predetermined pressure limit is for example of 10 bars, 20 bars, or 50 bars. This limit has to be determined accordingly with the cavity size and the leaking device flow.

The over pressure valve 23 is for example a ball check valve. The ball check valve comprises a support element, a ball, and a spring that loads the ball to the support element so as to close an opening. The tuning of the spring load is adapted to the predetermined pressure limit.

The predetermined pressure limit may insure that hydrates formation is prevented.

Moreover, the containment system 1 may comprise a drain valve for purging or limiting the quantity of water inside the cavity 21. Said drain valve might be positioned proximal to the base level BL (seafloor).

Figure 3:
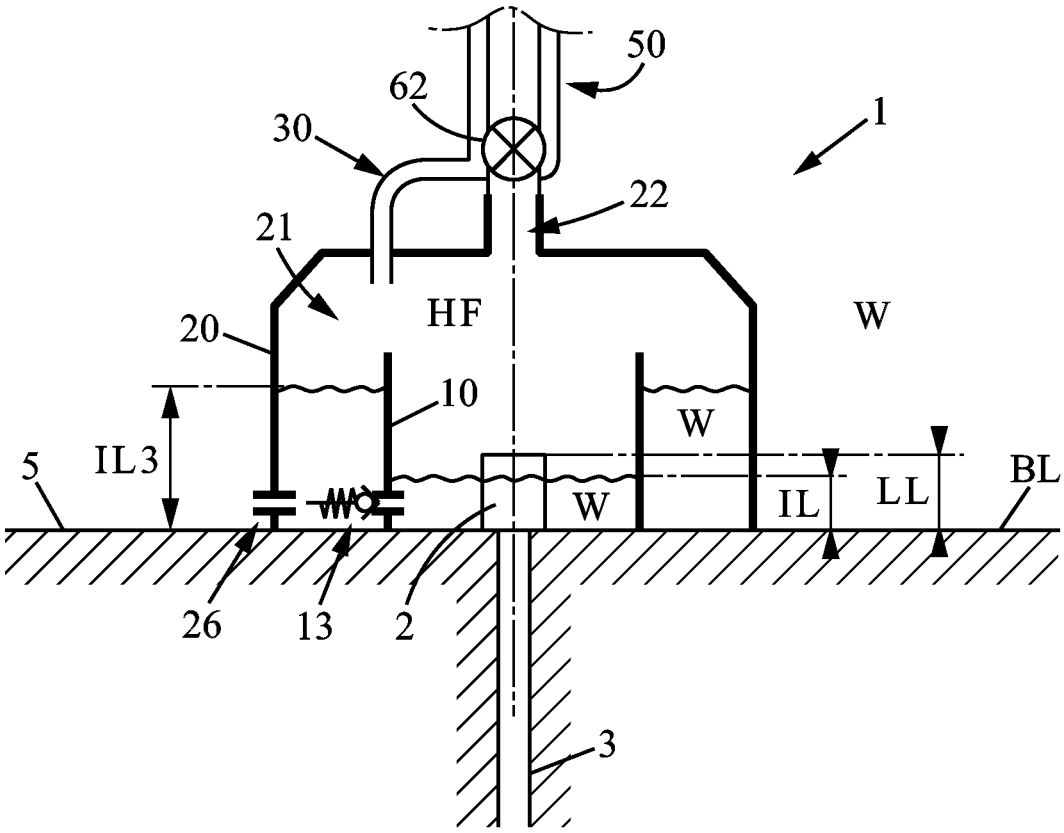
FIG. 3 is a vertical cut of a variant of the containment system of FIG. 1.

FIG. 3 is presenting a variant of the containment system of FIG. 1. In said variant, the containment system 1 further comprises a wall 10 installed around the leaking device 2. This wall 10 is extending from a lower end at the base level at the seafloor 5 to a first level above the leaking level LL and the level of the output opening 26. The wall 10 is for example a cylinder. Advantageously, the wall 10 is sealed or quasi-sealed to the seafloor 5 around the leaking device.

The wall 10 further comprises a one way valve 13 that allows the water inside the wall cavity to exit from it.

Thanks to this variant, the interface between hydrocarbon fluid HF and water W is divided into an inner interface and an outer interface. The inner interface is inside the wall cavity and it has a level, denoted interface level IL. The outer interface is outside the wall 10, i.e. between the wall 10 and the dome 20. It has a level denoted outer interface level IL3.

The sensor 60 may measure the inner interface level IL and/or the outer interface level IL3 instead of the interface level IL.

The measurement of the outer interface level permits the indirect control of the inner interface level IL. The wall 10 of present variant allows controlling a lower level of hydrocarbon fluid interface around the leaking device 2. Thanks, to such variant, a leaking device 2 having a leaking level LL near seafloor 5 and/or having an horizontal jet can be treated efficiently. The volume inside the wall 10 (wall cavity) is rapidly warmed by the hydrocarbon fluid itself, while the cold sea water is expulsed outside from this wall 10 by the one way valve 13. Hydrate formation is therefore prevented.

The output vale 62 is then controlled on the basis of the outer interface level IL3. It keeps the inner interface level IL at a level lower or equal to the leaking level LL of output of the hydrocarbon fluid, even if the outer interface level IL3 is higher than this level LL.

Figure 2A:
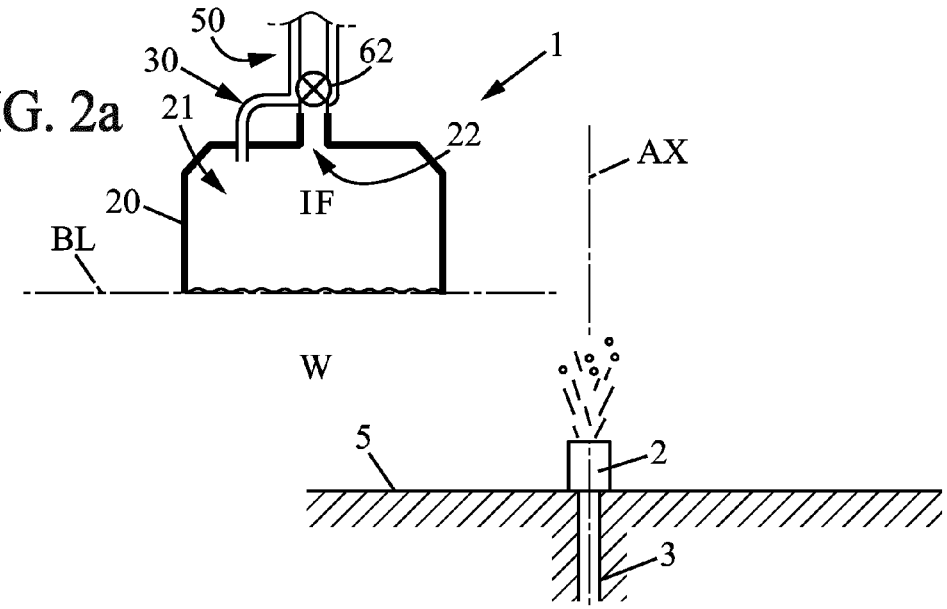
FIGS. 2*a*, 2*b*, and 2*c* are showing an example of the method for installing the containment system of FIG. 1.
Figure 2B:
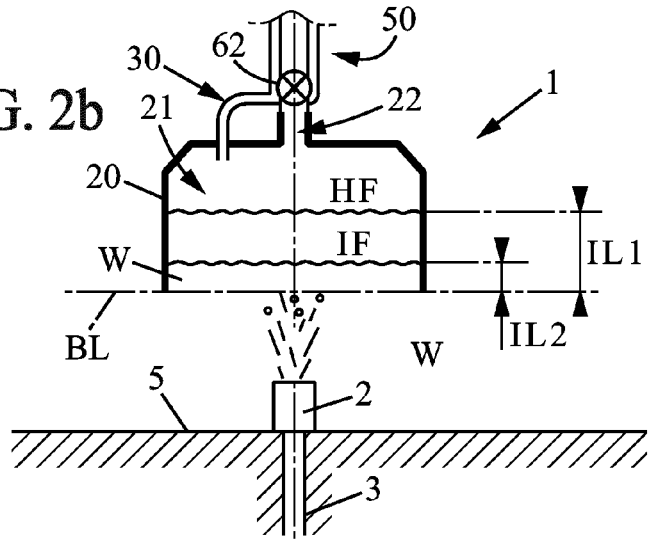
Figure 2C:
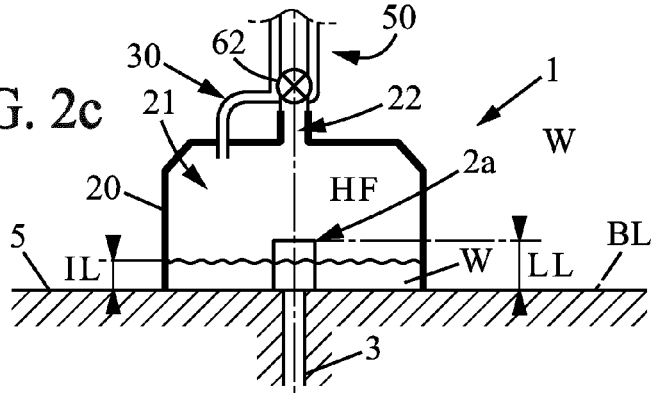

An example of the method for installing and using the containment system 1 according to the invention is now explained in view of FIGS. 2*a*, 2*b* and 2*c* corresponding to three successive states during installation. FIGS. 2*a* and 2*b* are states before the containment system 1 is landed at the seafloor and surrounding the leaking device 2. FIG. 2*c* is a state after the landing of the containment system 1 above the leaking device 2. On these figures, the base level corresponds to the lowest level of the containment system 1, i.e. the surface that will be in contact with the seafloor when it is landed.

On FIG. 2*a*, the containment system is not installed above the leaking device 2. It is near the seafloor 5, but positioned laterally aside the leaking device 2.

The dome 20 is firstly filled by the injection device 30 of an injection fluid IF. The used injection fluid is one of those listed, and is preferably heated.

The output valve 62 is now a valve situated just above the dome 20, preferably directly at the output of the upper output opening 22. In present case, this valve is not combined to a pump as it was on FIG. 1. However, any valve situated above the dome 20 can be used.

Then, the containment system 1 is laterally moved so to be positioned above the leaking device 2 (FIG. 2*b*), its dome 20 being substantially coaxial to the vertical direction AX defined by a vertical direction corresponding to the output of hydrocarbon fluid from the leaking device 2.

Hydrocarbon fluid HF has a density lower than injection fluid IF, and is accumulated inside the dome 20 in the upper portion of the cavity 21, the injection fluid IF being below said hydrocarbon fluid.

Therefore, there are a fluid interface between hydrocarbon fluid HF and injection fluid IF at a first interface level IL1, and a fluid interface between injection fluid IF and sea water W at a second interface level IL2.

To stabilise (keep constant) the first interface level IL1, the output valve 62 is opened (controlled) to evacuate a quantity of hydrocarbon fluid HF. The quantity of hydrocarbon is for example extracted via the pipe 50 or extracted to the sea for example via a chock valve.

The upper output opening 22 may be controlled on the basis of the first interface level IL1, said first interface level being measured by the sensor 60.

The upper output opening 22 may be controlled so that the first interface level IL1 is equal or higher than a first predetermined level. The first predetermined level may be relatively high and proximal to the upper output opening 22. The quantity of hydrocarbon fluid stored inside the cavity 21 is therefore small during this state, and the risk of hydrate accumulation and clogging the cavity is very low.

To stabilize the second interface level IL2, the injection device 30 is controlled to add a quantity of injection fluid IF inside the cavity 21.

The injection device 30 may be controlled on the basis of the second interface level IL2, said second interface level being measured by the sensor 60.

Advantageously, injection device 30 may be controlled so that the second interface level IL2 is equal or lower than a second predetermined level. The second predetermined level may be relatively low and proximal to the base level BL. The quantity of injection fluid stored inside the cavity 21 is therefore high during this state, and the risk of hydrate formation is reduced.

Thanks to the above method, the containment system 1 can be installed above the leaking device 2 without forming any hydrates. These transient states and steps are important for avoiding the hydrates formation.

Then, the containment system 1 is landed above the seafloor 5 and the dome 20 surrounds the leaking device 2 and encloses it (FIG. 2*c*).

The output valve 62 of the containment system 1 is controlled so as to substantially fill it with the hydrocarbon fluid outputting from the leaking device 2. This reduces the quantity of sea water inside the cavity 21 and therefore reduces the possibility of hydrates formation. The hydrocarbon fluid is relatively hot, and therefore storing a huge quantity of hydrocarbon fluid inside the cavity heats the entire cavity 21 and reduces the risk of hydrate formation inside said cavity.

During this state, the fluid interface between hydrocarbon fluid and any other fluid (sea water or injection fluid) is at an interface level IL.

The output valve 62 is controlled on the basis of the interface level IL, said interface level being measured by the sensor 60.

Advantageously, the output valve 62 is controlled so as to keep such interface level lower or equal to a level LL of output of the hydrocarbon fluid from the leaking device 2.

Thanks to the above method, the containment system 1 can be used permanently above the leaking device 2 without forming any hydrates.

The embodiments above are intended to be illustrative and not limiting. Additional embodiments may be within the claims. Although the present invention has been described with reference to particular embodiments, workers skilled in the art will recognize that changes may be made in form and detail without departing from the spirit and scope of the invention.

Various modifications to the invention may be apparent to one of skill in the art upon reading this disclosure. For example, persons of ordinary skill in the relevant art will recognize that the various features described for the different embodiments of the invention can be suitably combined, un-combined, and re-combined with other features, alone, or in different combinations, within the spirit of the invention. Likewise, the various features described above should all be regarded as example embodiments, rather than limitations to the scope or spirit of the invention. Therefore, the above is not contemplated to limit the scope of the present invention.

The invention claimed is:

1. A containment system for recovering hydrocarbon fluid from a leaking device that is situated at the seafloor and that is leaking hydrocarbon fluid from a well, wherein the containment system is adapted to be landed at the seafloor corresponding to a base level of the containment system, and wherein the containment system comprises a dome forming a cavity under said dome, said cavity being adapted to completely surround and include the leaking device, and to accumulate hydrocarbon fluid coming upwardly from the leaking device, said dome comprising at least one upper output opening adapted to extract the hydrocarbon fluid for recovery, and wherein the containment system is characterised in that it further comprises:

a sensor for measuring an interface level of a fluid interface between hydrocarbon fluid and any other fluid inside the dome, an output valve connected to the upper output opening for outputting hydrocarbon fluid from the cavity, said output valve being controlled on the basis of the interface level measured by the sensor, and a control unit that implements a level control law so as to keep the interface level lower or equal to a level of output of the hydrocarbon fluid from the leaking device.

2. The containment system according to claim 1, wherein the dome comprises:

a first valve for extracting a gas component from the cavity, said first valve being positioned on the dome at a level proximal to a highest level of the dome, and a second valve for extracting a liquid component from the cavity, said second valve being positioned on the dome at an intermediate level intermediate between the base level and the highest level of the dome.

3. The containment system according to claim 2, further comprising a control unit that implements a separation control law that controls the first valve so as a gas interface level is lower than the highest level of the dome, and so as a liquid interface level is lower than the intermediate level.

4. The containment system according to claim 1, wherein the dome comprises an over pressure valve that extract fluid out from the cavity to the environment if a pressure difference between the cavity and the environment exceeds a predetermined pressure limit.

5. The containment system according to claim 1, wherein the dome comprises an injection device that inputs an injection fluid into the cavity.

6. The containment system according to claim 5, wherein the injection device comprises a plurality of output ports inside the cavity, said output ports being fed with the injection fluid.

7. The containment system according to claim 5, wherein the injection fluid comprises one or a combination of the fluid components chosen in the list of an alcohol, an ethanol, a methanol, a glycol, an ethylene glycol, a diethylene glycol, and a low-dosage hydrate inhibitor.

8. A method for using a containment system for recovering hydrocarbon fluid from a leaking device that is situated at the seafloor and that is leaking hydrocarbon fluid from a well, and wherein the containment system comprises:

a dome forming a cavity under said dome, said cavity being adapted to completely surround and include the leaking device, and to accumulate hydrocarbon fluid coming upwardly from the leaking device, said dome comprising at least one upper output opening, a sensor, an output valve connected to the upper output opening, and a control unit implementing a level control law, wherein the method comprises the following successive steps:

a) measuring by the sensor an interface level of a fluid interface between hydrocarbon fluid and any other fluid inside the dome, b) controlling by the level control law of the control unit the output valve on the basis of the interface level measured by the sensor for outputting hydrocarbon fluid from the cavity so as to keep the interface level lower or equal to a level of output of the hydrocarbon fluid from the leaking device.

9. The method according to claim 8, wherein the dome further comprises an injection device that is able to input an injection fluid into the cavity, and wherein, after landing the containment system at the seafloor and surrounding the leaking device, the method comprises the following steps:

measuring by the sensor a first interface level of a fluid interface between hydrocarbon fluid and injection fluid inside the dome, controlling the output valve on the basis of the first interface level measured by the sensor for outputting hydrocarbon fluid from the cavity, measuring by the sensor a second interface level of a fluid interface between injection fluid and water inside the dome, and controlling the injection device on the basis of the second interface level measured by the sensor for adding injection fluid inside the cavity.

10. The method according to claim 9, wherein at the upper output opening is controlled so as to keep the first interface level at a level higher than a first predetermined level, said first predetermined level being preferably proximal to the upper output opening.

11. The method according to claim 9, wherein the injection device is controlled so as to keep the second interface level at a level lower than a second predetermined level, said second predetermined level being preferably proximal to the base level.

* * * * *